US005328107A

United States Patent [19]

Tsai

[11] Patent Number: 5,328,107

[45] Date of Patent: Jul. 12, 1994

[54] PAPER SHREDDING ROLLER FOR A PAPER SHREDDER

[76] Inventor: Shao-Nong Tsai, 4F, No. 208, Sec. 1, Wen-Hua Rd., Yung-Ho City, Taiwan

[21] Appl. No.: 62,612

[22] Filed: May 18, 1993

[51] Int. Cl.[5] ..... B02C 18/06

[52] U.S. Cl. ..... 241/295; 241/236

[58] Field of Search ..... 241/295, 236, 292.1, 241/235, 230

[56] References Cited

U.S. PATENT DOCUMENTS 3,141,168 8/1992 Pepper ..... 241/295 X

*Primary Examiner*—Douglas D. Watts

*Attorney, Agent, or Firm*—Beveridge, DeGrandi, Weilacher & Young

[57] ABSTRACT

A paper shredding roller includes a rotatable knife shaft, a plurality of circular knives and a plurality of circular spacers. The knife shaft has a polygonal cross-section. Each of the circular knives is provided on the knife shaft and has a polygonal central through hole that corresponds with the cross-section of the knife shaft so as to permit the knife shaft to extend fittingly therethrough. Each of the circular knives is provided with a plurality of equiangularly spaced unidirectional cutting elements, the number of which is unequal to a number of sides of the knife shaft. The cutting knives are provided on the knife shaft in such a manner that the cutting elements of each circular knife are displaced angularly by a predetermined angle from corresponding ones of the cutting elements of an adjacent one of the circular knives so that the cutting elements of the circular knives are arranged on a number of helical rows that extend along the rotatable knife shaft. Each of the circular spacers is provided on the knife shaft between every two adjacent ones of the circular knives.

5 Claims, 3 Drawing Sheets

PAPER SHREDDING ROLLER FOR A PAPER SHREDDER

BACKGROUND OF THE INVENTION

1. Field of the Invention

The invention relates to a paper shredding roller for a paper shredder and to the method for manufacturing the same, more particularly to an improved paper shredding roller which is capable of cutting paper documents into smaller pieces than the prior art.

2. Description of the Related Art

Paper shredders are used to replace tearing or burning of confidential documents when destroying the latter. Referring to FIG. 1, a conventional paper shredder for cutting paper documents into strips is shown to comprise a pair of shredding rollers (A) which respectively include a plurality of flat circular knives that are separated by circular spacers. The cutting edge of the circular knives may be plain or saw-toothed. A main drawback of the conventional paper shredder shown in FIG. 1 is that the size of the strips produced thereby is relatively large, thus making it possible to piece together the shredded documents. Furthermore, since the strips are not compact, the enclosure (not shown) for receiving the strips is easily filled.

FIG. 2 is an illustration of another conventional paper shredder. The paper shredder comprises a pair of shredding rollers (B) which rotate synchronously in opposite directions and which respectively include a plurality of spaced circular knives (B1). The periphery of each of the circular knives (B1) is formed with a predetermined number of equiangularly spaced ratchet teeth-type cutting elements (B11). The cutting elements (B11) of the circular knives (B1) are aligned, thereby forming a number of axially extending rows of cutting elements (B11) along the length of a rotatable knife shaft (B2). The paper shredder shown in FIG. 2 can cut paper documents into smaller bits and pieces, thereby overcoming the drawbacks of the paper shredder shown in FIG. 1. However, since contact between the cutting elements (B11) of the circular knives (B1) of the shredding rollers (B) occurs when the paper shredder is in operation, resistance to movement of the shredding rollers (B) is produced. Thus, a motor with a greater output power is required in order to overcome the resistance that is generated, thereby resulting in higher costs.

Still another example of a conventional paper shredder has a pair of shredding rollers that are formed as cylindrical shafts with a plurality of staggered cutting teeth provided thereon. Contact between the cutting teeth of the shredding rollers does not occur when the paper shredder is in use, thereby overcoming the drawbacks associated with the paper shredder shown in FIG. 2. However, a computer numeric controlled (CNC) process is employed so as to form the cutting teeth on the shredding rollers. The shredding rollers are thus expensive and inconvenient to manufacture.

SUMMARY OF THE INVENTION

Therefore, the objective of the present invention is to provide an improved paper shredding roller which is easy to assemble, which is relatively low-cost, and which is capable of cutting paper documents into smaller pieces than most conventional shredding rollers.

Accordingly, the preferred embodiment of a paper shredding roller of the present invention includes a rotatable knife shaft, a plurality of circular knives and a plurality of circular spacers. The knife shaft has a polygonal cross-section. Each of the circular knives is provided on the knife shaft and has a polygonal central through hole that corresponds with the cross-section of the knife shaft so as to permit the knife shaft to extend fittingly therethrough. Each of the circular knives is provided with a plurality of equiangularly spaced unidirectional cutting elements, the number of which is unequal to a number of sides of the knife shaft. The cutting knives are provided on the knife shaft in such a manner that the cutting elements of each circular knife are displaced angularly by a predetermined angle from corresponding ones of the cutting elements of an adjacent one of the circular knives so that the cutting elements of the circular knives are arranged on a number of helical rows that extend along the rotatable knife shaft. Each of the circular spacers is provided on the knife shaft between every two adjacent ones of the circular knives.

BRIEF DESCRIPTION OF THE DRAWINGS

Other features and advantages of the present invention will become apparent in the following detailed description of the preferred embodiments, with reference to the accompanying drawings, of which.

DETAILED DESCRIPTION OF THE PREFERRED EMBODIMENTS

Figure 1:
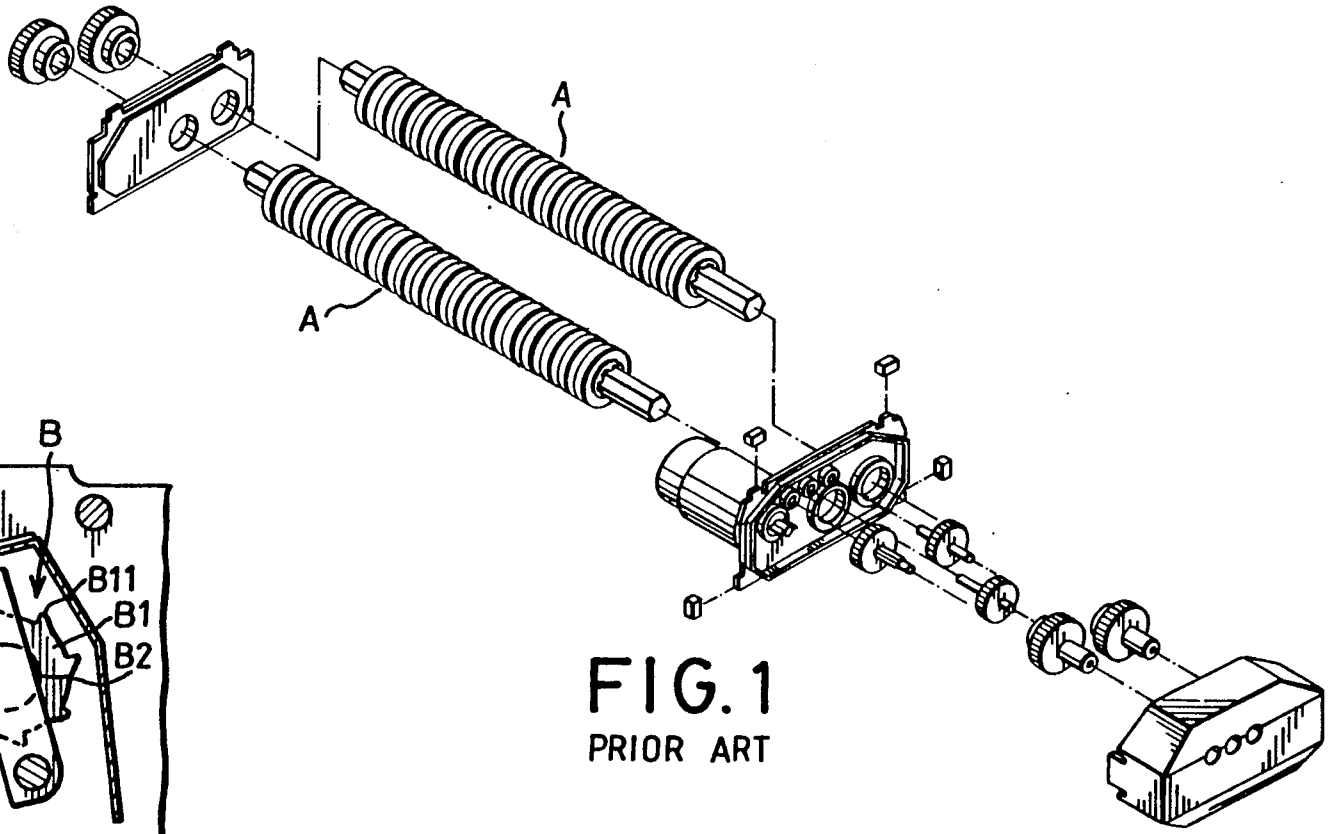
FIG. 1 PRIOR ART
FIG. 1 is a fragmentary exploded view of a conventional paper shredder.
Figure 2:
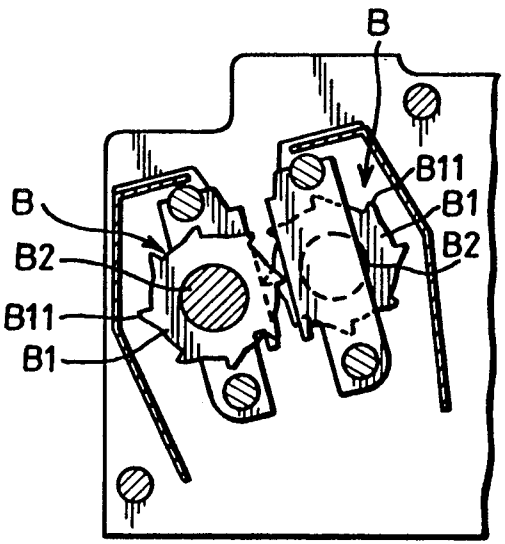
FIG. 2 PRIOR ART
FIG. 2 is an illustration of another conventional paper shredder.
Figure 3:
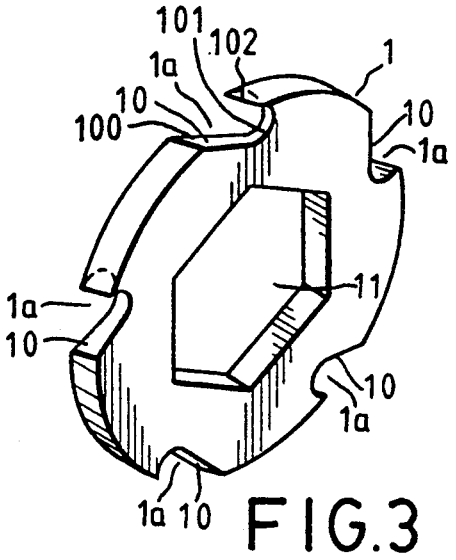
FIG. 3 is a rear perspective view of the first preferred embodiment of a circular knife of the paper shredding roller according to the present invention.
Figure 6:
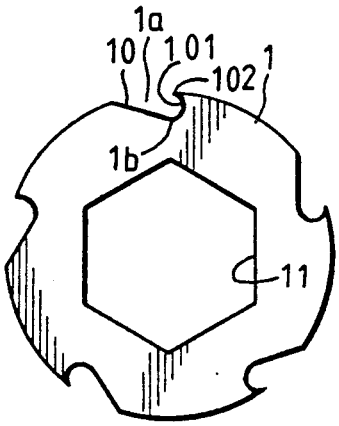
FIG. 6 is a rear view of the circular knife shown in FIG. 3.

FIG. 3 shows the first preferred embodiment of a circular knife (1) or the paper shredding roller of the present invention. The circular knife (1) is provided with five equiangularly spaced unidirectional cutting elements, each of which including a cutting groove (1*a*) formed on the periphery of the circular knife (1) and provided with a leading edge and a lagging edge. The cutting groove (1*a*) has a depth that increases gradually from the leading edge to the lagging edge, and a groove bottom (1*b*) formed at the lagging edge thereof, as shown in FIG. 6. Each of the cutting elements further includes a cutting edge (10) formed at the cutting groove (1*a*). The cutting edge (10) has a sloping portion (100) which extends from the leading edge to the groove bottom (1*b*) of the cutting groove (1*a*), and a substantially U-shaped curve portion (101) which extends from the groove bottom (1*b*) of the cutting groove (1*a*) to the periphery of the circular knife (1). The cutting edge (10) is inclined from the front side of the circular knife (1) to the rear side of the latter in a radial outward direction in order to facilitate cutting of paper documents.

Each of the cutting elements further includes a cutting tip (102) that extends circumferentially from a distal end of the curve portion (101) of the cutting edge (10) in a direction toward the leading edge of the cutting groove (1*a*). Referring once more to FIG. 3, the cutting tip (102) is tapered and has an edge that inclines from the rear side to the front side of the circular knife (1) in an axial direction of the latter.

Figure 4:
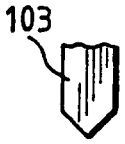
FIG. 4 is an enlarged view of a cutting tip of a cutting element of the second preferred embodiment of a circular knife of the paper shredding roller according to the present invention.
Figure 5:
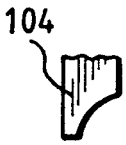
FIG. 5 is an enlarged view of a cutting tip of a cutting element of the third preferred embodiment of a circular knife of the paper shredding roller according to the present invention.

FIGS. 4 and 5 respectively illustrate the cutting tip of a cutting element of the second and third preferred embodiments of a circular knife of the paper shredding roller according to the present invention. The cutting tip (103) of the cutting element of the second preferred embodiment is triangular, as shown in FIG. 4, while the cutting tip (104) of the cutting element of the third preferred embodiment has a straight distal portion, a curved portion and a width which decreases from the cutting edge to the distal portion of the cutting tip (104). The cutting tips (102, 103, 104) of the cutting elements of the three embodiments are designed so as to reduce the resistance force that is generated when a paper document is cut.

Figure 7:
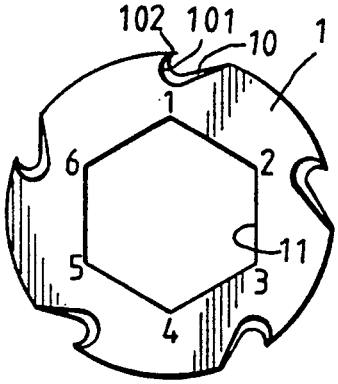
FIG. 7 is a front view of the circular knife shown in FIG. 3.

Referring to FIGS. 3, 6 and 7, the circular knife (1) is formed with a polygonal central through hole (11). In this embodiment, the central through hole (11) has six sides so as to permit a hexagonal rotatable knife shaft (2) to extend fittingly therethrough, as shown in FIG. 9.

Figure 8:
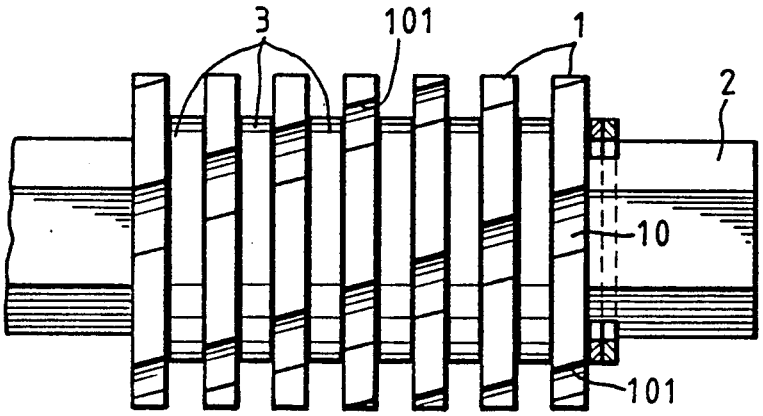
FIG. 8 is a side view of the paper shredding roller of the present invention.
Figure 9:
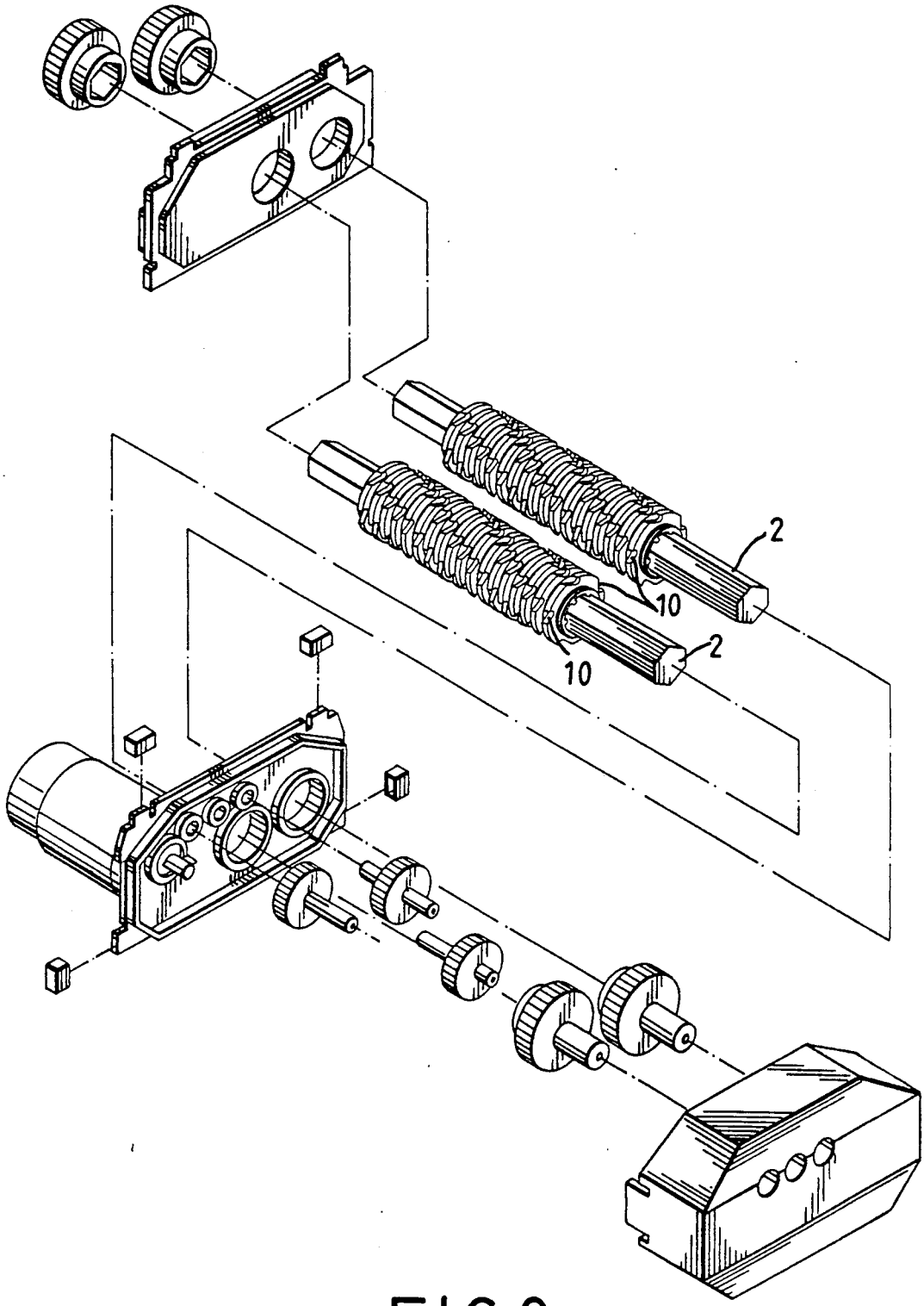
FIG. 9 is a fragmentary exploded view of a paper shredder which incorporates the paper shredding roller of the present invention.

Referring to FIGS. 8 and 9, a plurality of the circular knives (1) are provided on the rotatable knife shaft (2) and are spaced apart by circular spacers (3) in order to form the paper shredding roller of the present invention. The circular knives (1) are provided on the knife shaft (2) in such a manner that the cutting elements of each circular knife (1) are displaced angularly by a predetermined angle from corresponding ones of the cutting elements of an adjacent one of the circular knives (1). Thus, the cutting elements of the circular knives (1) are not arranged on a number of axially extending rows along the length of the rotatable knife shaft (2) but are instead arranged on a plurality of helical rows that extend along the rotatable knife shaft (2). In this embodiment, the cutting elements of each circular knife (1) are displaced by a 12° angle with respect to the corresponding ones of the cutting elements of the adjacent one of the circular knives (1). Referring once more to FIG. 7, the six corners of the central through hole (11) of each circular knife (1) are numbered sequentially in order to facilitate proper positioning of the circular knives (1) on the rotatable knife shaft (2).

Referring once more to FIG. 9, a paper shredder which incorporates the present invention requires two paper shredding rollers that are meshed in order to effect a cutting operation. The remaining components of the paper shredder are known in the art and are not related directly to the present invention, and thus, will not be detailed herein.

The advantages and characterizing features of the paper shredding roller according to the present invention are as follows:

1. Less resistance to the cutting of a paper document is generated, thereby minimizing the risk of damage to the motor of the paper shredder.

2. The paper shredding roller permits the cutting of documents into very small pieces, thereby making it impossible to piece together the shredded documents and preventing an enclosure for receiving the shredded pieces from being filled easily.

2. No special manufacturing process is required in order to fabricate the paper shredding roller of the present invention. The paper shredding roller is easy to assemble, thereby resulting in a quicker manufacturing process and in lower manufacturing costs.

4. The circular knives of the paper shredding roller can be easily replaced when damaged.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A paper shredding roller, comprising:

a rotatable knife shaft which has a polygonal cross-section;

a plurality of circular knives provided on said knife shaft, each of said circular knives having a polygonal central through hole that corresponds with the cross-section of said knife shaft so as to permit said knife shaft to extend fittingly therethrough, each of said circular knives being provided with a number of equiangularly spaced unidirectional cutting elements, the number of said cutting elements being unequal to a number of sides of said knife shaft, said cutting knives being provided on said knife shaft in such a manner that said cutting elements of each said circular knife are displaced angularly by a predetermined angle from corresponding cutting elements of an adjacent said circular knife so that said cutting elements of each said circular knife are displaced angularly by a predetermined angle from corresponding cutting elements of an adjacent said circular knife so that said cutting elements of said circular knives are arranged in a number of helical rows that extend along said rotatable knife shaft; and a circular spacer provided on said knife shaft between every two adjacent said circular knives;

wherein each of said cutting elements includes a cutting groove formed on a periphery of said circular knife and provided with a leading edge and a lagging edge, said cutting groove having a depth that increases gradually from said leading edge to said lagging edge and a groove bottom formed at said lagging edge thereof, each of said cutting elements further including a cutting edge formed at said cutting groove, said cutting edge having a sloping portion which extends from said leading edge to said groove bottom of said cutting groove and a substantially U-shaped curve portion which extends from said groove bottom of said cutting groove to the periphery of said circular knife.

2. The paper shredding roller as claimed in claim 1, wherein said knife shaft is hexagonal in cross-section.

3. The paper shredding roller as claimed in claim 2, wherein the number of said cutting elements of each said circular knife is equal to five.

4. The paper shredding roller as claimed in claim 1, wherein said cutting edge of each of said cutting elements is inclined from a front side of said circular knife to a rear side of said circular knife in a radial outward direction.

5. The paper shredding roller as claimed in claim 1, wherein each of said cutting elements further includes a cutting tip that extends circumferentially from a distal end of said curve portion of said cutting edge in a direction toward said leading edge of said cutting groove.

* * * * *